US008250879B2

(12) United States Patent
MacBain et al.

(10) Patent No.: US 8,250,879 B2
(45) Date of Patent: Aug. 28, 2012

(54) DUAL-CIRCUIT CHILLER WITH TWO-PASS HEAT EXCHANGER IN A SERIES COUNTERFLOW ARRANGEMENT

(75) Inventors: Scott M. MacBain, Syracuse, NY (US); Michael A. Stark, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 536 days.

(21) Appl. No.: 12/444,934

(22) PCT Filed: Oct. 10, 2006

(86) PCT No.: PCT/US2006/039513

§ 371 (c)(1),
(2), (4) Date: Jan. 11, 2010

(87) PCT Pub. No.: WO2008/045039

PCT Pub. Date: Apr. 17, 2008

(65) Prior Publication Data

US 2010/0107683 A1 May 6, 2010

(51) Int. Cl.
*F25B 7/00* (2006.01)

(52) U.S. Cl. ..... 62/335

(58) Field of Classification Search ..... 62/335, 62/428, 504, 410, 513
See application file for complete search history.

(56) References Cited

U.S. PATENT DOCUMENTS 3,664,150 A 5/1972 Patterson
4,040,268 A 8/1977 Howard
4,272,967 A 6/1981 White et al.
5,083,438 A * 1/1992 McMullin ..... 62/129
5,108,475 A 4/1992 Briggs
5,307,645 A 5/1994 Pannell
5,355,691 A * 10/1994 Sullivan et al. ..... 62/201
5,875,637 A 3/1999 Paetow
5,954,127 A 9/1999 Chrysler et al.
6,035,655 A 3/2000 Hare et al.
6,053,238 A 4/2000 Goth et al.
6,067,815 A 5/2000 James
6,109,044 A 8/2000 Porter et al.
6,116,048 A 9/2000 Hebert
6,161,613 A * 12/2000 Huenniger ..... 165/145
6,202,431 B1 * 3/2001 Beaverson et al. ..... 62/196.3
6,244,058 B1 * 6/2001 Duga et al. ..... 62/177
6,266,968 B1 7/2001 Redlich
6,298,683 B1 10/2001 Kondo et al.

(Continued)

OTHER PUBLICATIONS

International Search Report and Written Opinion mailed Mar. 22, 2007 (10 pgs.).

(Continued)

*Primary Examiner* — Mohammad Ali
(74) *Attorney, Agent, or Firm* — Cantor Colburn LLP

(57) ABSTRACT

A dual refrigeration circuit, watercooled chiller has its respective evaporators and condensers interconnected by waterboxes, with each waterbox having an inlet flow and outlet flow connection, and with three passages interconnected with the respective evaporators/condensers of the first and second circuit, and with each of the condensers/evaporators having return bends at their ends to provide a two-pass flow arrangement. The flow in the condenser waterbox passes into a first passage and then in one direction to the condenser of one circuit while the flow into the evaporator waterbox passes into a first passage and then in the opposite direction to one of the circuit evaporators. In this manner, a series counterflow arrangement with two water passes is achieved.

9 Claims, 7 Drawing Sheets

U.S. PATENT DOCUMENTS

| | | | | |
|---|---|---|---|---|
| 6,370,908 | B1 | 4/2002 | James | |
| 6,516,627 | B2 * | 2/2003 | Ring et al. | 62/471 |
| 6,993,923 | B2 | 2/2006 | Beers | |
| 7,032,411 | B2 | 4/2006 | Hebert | |

OTHER PUBLICATIONS

International Preliminary Report on Patentability mailed Sep. 26, 2008 (6 pgs.).

* cited by examiner

DUAL-CIRCUIT CHILLER WITH TWO-PASS HEAT EXCHANGER IN A SERIES COUNTERFLOW ARRANGEMENT

BACKGROUND OF THE INVENTION

This invention relates generally to water cooled chillers and, more specifically, to the interconnection of two vapor compression refrigeration systems in a series-counterflow arrangement.

Water cooled chillers in a series-counterflow arrangement consist of two independent vapor compression refrigeration systems with chilled water and condenser water circuits that are common to both circuits and are arranged in series. This arrangement allows for an increased coefficient of performance (COP) over a single refrigeration circuit design because the separate circuits with series counterflow have a lower average pressure differential between the evaporator and condenser, thus requiring less energy to compress refrigerant from the evaporator to the condenser.

In such a system, water in each of the evaporators and the condensers flows through a plurality of tubes that span both refrigeration circuits, with the refrigeration circuits being separated by a tubesheet which is located at the middle of the tubes, and with each tube being hermetically sealed to the tubesheet, typically by expansion of the tube to the tubesheet.

One problem that arises is that of servicing the tubes such as may be required if a tube fails in operation. Such removal of a tube requires cutting the tube at all locations where it has been expanded and then pulling the tube out. It is not possible to completely remove a tube since there is no access to cut the tube at the center tubesheet location, which is inside the refrigerant boundary. If a tube is cut internally, or if a tube fails in operation, a leak path is created between the circuits that does not allow for operation of either circuit, thus adversely impacting both reliability and serviceability.

Another problem with a dual circuit system is that of control. A critical parameter for control of a water cooled chiller is the use of the leaving temperature differential, which is the difference in the temperature of the water leaving a heat exchanger and the refrigerant temperature within the heat exchanger. Since the water tubes span both refrigerant circuits in a dual system, it is not possible to obtain the leaving water temperatures of the upstream circuit's condenser or evaporator.

In addition to serviceability and control as discussed hereinabove, prior art heat exchanger tubes that span dual circuits pose problems of reliability, accessibility, shipping and performance. That is, because the common tubes extend across both circuits, it is impossible to optimize the heat transfer tubes in each circuit independently, and shipping of machines that are longer due to the longer tubes can be difficult.

It is desirable to have a two water pass arrangement, wherein entering and leaving water connections can be made from the same location on the chiller, thus allowing access to a tubesheet of the cooler and condenser on the non-connection end without requiring removal of the water piping to the chiller for cleaning or replacing tubes. Also, for those skilled in the art, a two pass arrangement can be desirable for obtaining higher water velocities in the heat exchanger tubes while maintaining a fixed number of heat exchanger tubes. This invention allows for two pass heat exchangers with a series counterflow arrangement by way of a novel machine arrangement and waterbox design.

SUMMARY OF THE INVENTION

Briefly, in accordance with one aspect of the invention, each circuit has unique tubesheets that separate the refrigeration circuit from the cooling medium. Between each circuit is an intermediate waterbox that passes water from the upstream circuit to the downstream circuit. The waterbox is removable for service and enables the transporting of the units in pieces with shorter length requirements.

In accordance with another aspect of the invention, since each circuit has its separate and unique tubes, a tube failure in either circuit no longer creates a refrigerant leak path to the adjacent circuit, such that operation of the nonfailed circuit can be maintained, thereby increasing reliability.

By another aspect of the invention, since the intermediate waterbox is accessible from the outside, temperature measurement instrumentation can be installed to obtain the leaving temperature differential of the upstream circuit, thereby providing better control of the system.

In accordance with another aspect of the invention, provision is made in both the cooler and condenser for the entering and leaving water connections to be made at the same location on the intermediate waterbox, thus greatly facilitating access thereto.

By another aspect of the invention, each of the cooler and condenser intermediate waterboxes have three separate passages, and the entering and leaving water directions are reversed in the respective cooler and condenser waterboxes such that the respective flows are in a series counterflow arrangement.

In the drawings as hereinafter described, a preferred embodiment is depicted; however, various other modifications and alternate constructions can be made thereto without departing from the spirit and scope of the invention.

DESCRIPTION OF THE PREFERRED EMBODIMENT

Figure 1:
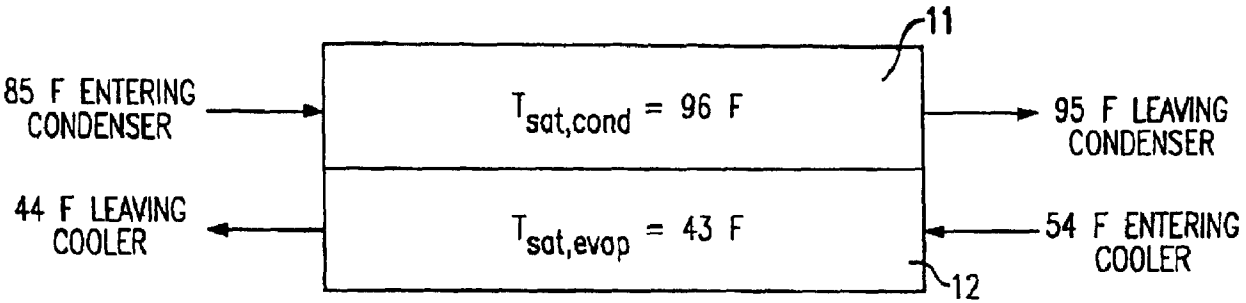
FIG.1 Prior Art
FIG. 1 is a schematic illustration of the temperatures in a single circuit chiller in accordance with the prior art.

FIG. 1 shows a condenser 11 and a cooler or evaporator 12 of a single circuit chiller that is typical of the prior art. As shown, the condenser water and evaporator water flows in a counterflow relationship, and the resulting temperatures entering and leaving the condenser and evaporator are as shown.

Figure 2:
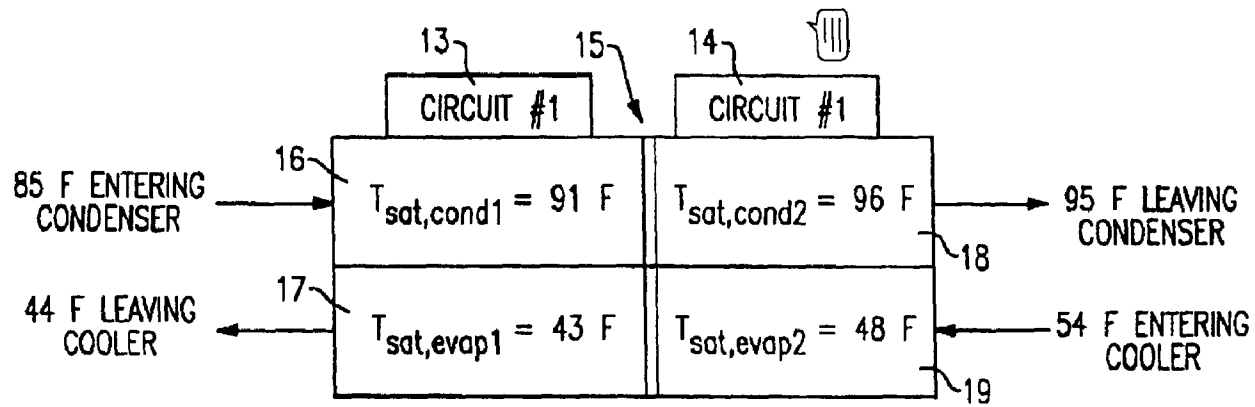
FIG.2 Prior Art
FIG. 2 is a schematic illustration of the temperatures in a dual-circuit chiller in accordance with the prior art.

In order to obtain increased COPs, a dual-circuit is connected in series counterflow arrangement as shown in FIG. 2. Here, two independent vapor compression refrigeration circuits, 13 and 14, are connected by an intermediate tubesheet 15 as shown. The first circuit 13 has a condenser 16 and an evaporator 17, and the second circuit 14 has its own condenser 18 and evaporator 19. However, the condenser water circuits of the condenser 16 and 18 are common to both circuits and are arranged in series. Also, the chilled water circuits of the evaporators 17 and 19 are common to both circuits and are arranged in series. This can be best seen by reference to FIG. 3.

Figure 3:
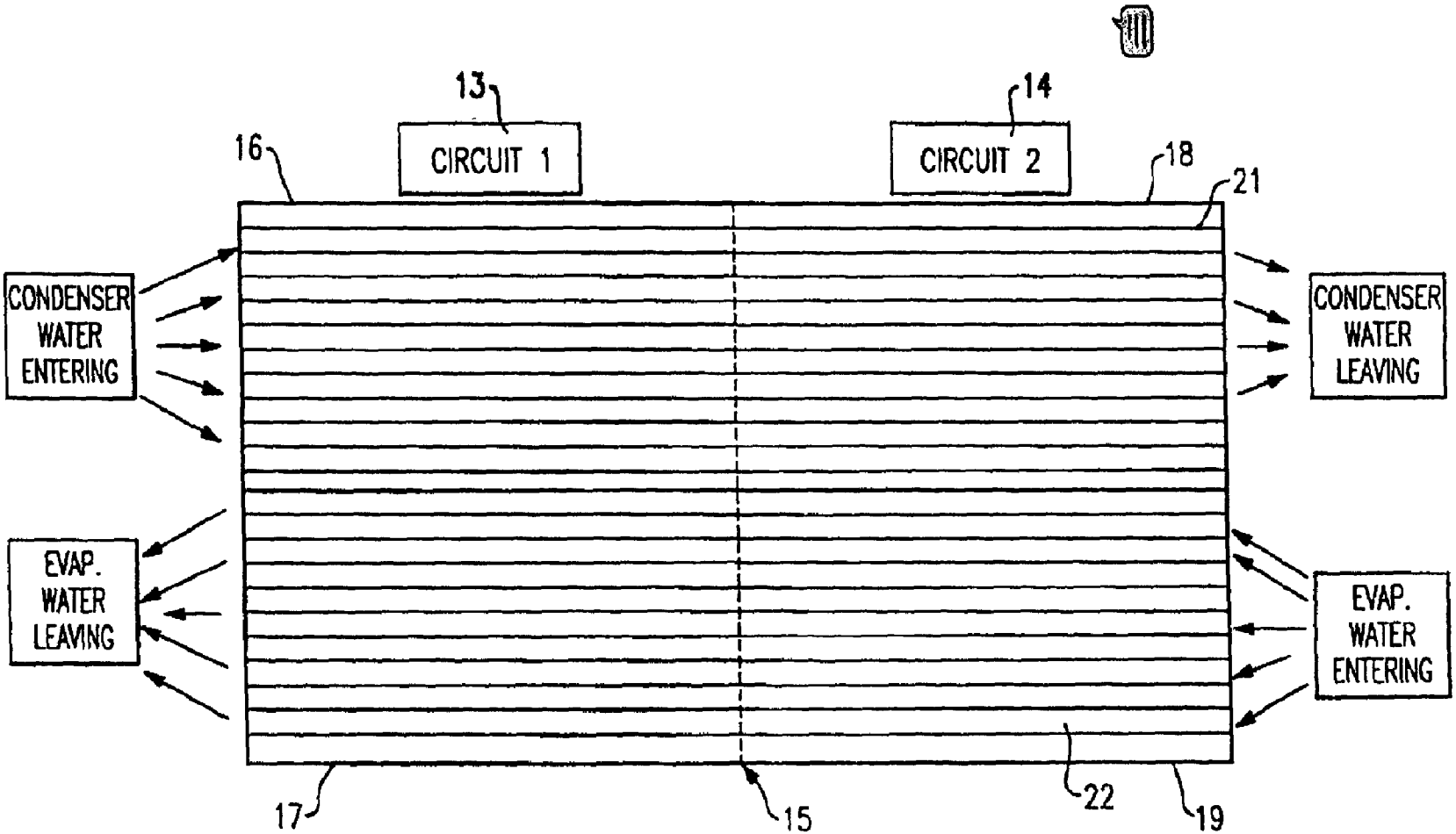
FIG.3 Prior Art
FIG. 3 is a schematic illustration of the condensers and evaporators of a dual-circuit chiller in accordance with the prior art.

It will be seen in FIG. 3 that the condenser tubes 21 are long and span the length of each of the condensers 16 and 18 of the circuits 13 and 14. While the intermediate tubesheet 15 isolates and separates the refrigerant in the respective circuits 13 and 14, the water flow through the condenser tubes 21 is continuous from the entrance of the condenser 16 to the outlet of the condenser 18.

Similarly, the evaporator tubes 22 are unitary members that extend across both circuits 13 and 14, with the intermediate tubesheets providing isolation only for the refrigerant in the systems 13 and 14, but allow for the evaporator water to flow continuously from the inlet end of the evaporator 19 to the outlet end of the evaporator 17.

The series counterflow effect is achieved by separation of the heat exchangers into two isolated circuits. With typical refrigerant heat exchangers, the saturation conditions for the cooler and condenser are a function of the leaving water temperature from each circuit. With a single circuit chiller, shown in FIG. 2, typical leaving water temperatures for the cooler and condenser would be 44 F and 95 F, respectively. An efficient water/refrigerant heat exchanger would have a difference in temperature between the leaving water and the refrigerant, or LTD, of approximately 1 degree F., thus in the single circuit case, the saturation temperatures would be 43 F in the cooler, and 96 F in the condenser, see FIG. 1. The resulting lift is the difference, or 53 degrees F. In a two circuit design with equivalent refrigeration effect in each circuit, the water temperature in the middle of the two circuits is approximately the mean of the entering and leaving temperatures. In the example of FIG. 2 above, the temperature in between the cooler and condenser circuits would be 49 F and 90 F, respectively. With typical heat exchanger LTD's, the saturation conditions for the two cooler circuits would then be approximately 48 F and 43 F, and the saturation conditions for the two condensers would be approximately 96 F and 91 F. With the series counterflow design, the cooler and condenser water enter from opposite ends, therefore the cooler and condenser circuits are paired so that the higher saturation cooler is on the same circuit with the higher saturation temperature condenser, and the two lower saturations heat exchangers are paired. The result is that each refrigerant circuit has the same lift, and the lift for each circuit is less than the single circuit design. In the examples described above, the single circuit lift was 53 degrees F. and the series counterflow lift was 48 degrees F. The series counterflow arrangement has approximately 10% less lift, thus greater system efficiency.

As discussed hereinabove, such dual-circuit systems with heat exchanger tubes that span both circuits present problems with respect to service, reliability, shipping, performance, control and accessibility.

Figure 4:
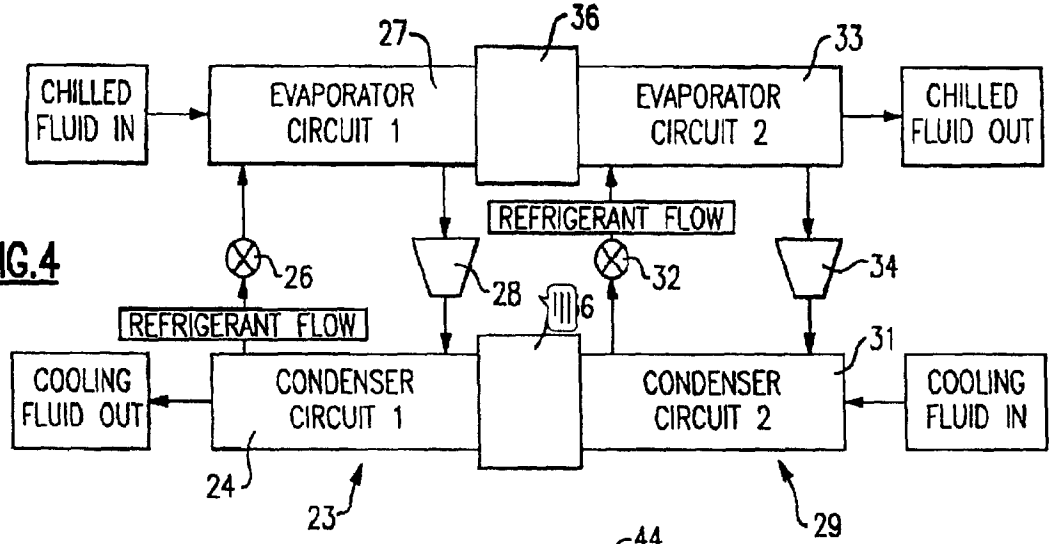
FIG. 4 is a schematic illustration of dual-circuit chiller system in accordance with one aspect of the present invention.

Referring now to FIG. 4, a system is shown to overcome the above-discussed problems. A first circuit, 23, includes a condenser 24, an expansion device 26, an evaporator 27 and a compressor 28, which operate in serial flow relationship in a well-known manner. A second circuit, 29, includes a condenser 31, an expansion device 32, an evaporator 33 and a compressor 34 which also are connected in serial flow relationship and operate in a well known manner. The two circuits 23 and 29 are interconnected in a manner similar to that shown in FIG. 3 but with a different structure at the interface between the two circuits and different structure with respect to the tubes within both the condensers and the evaporators.

Figure 5:
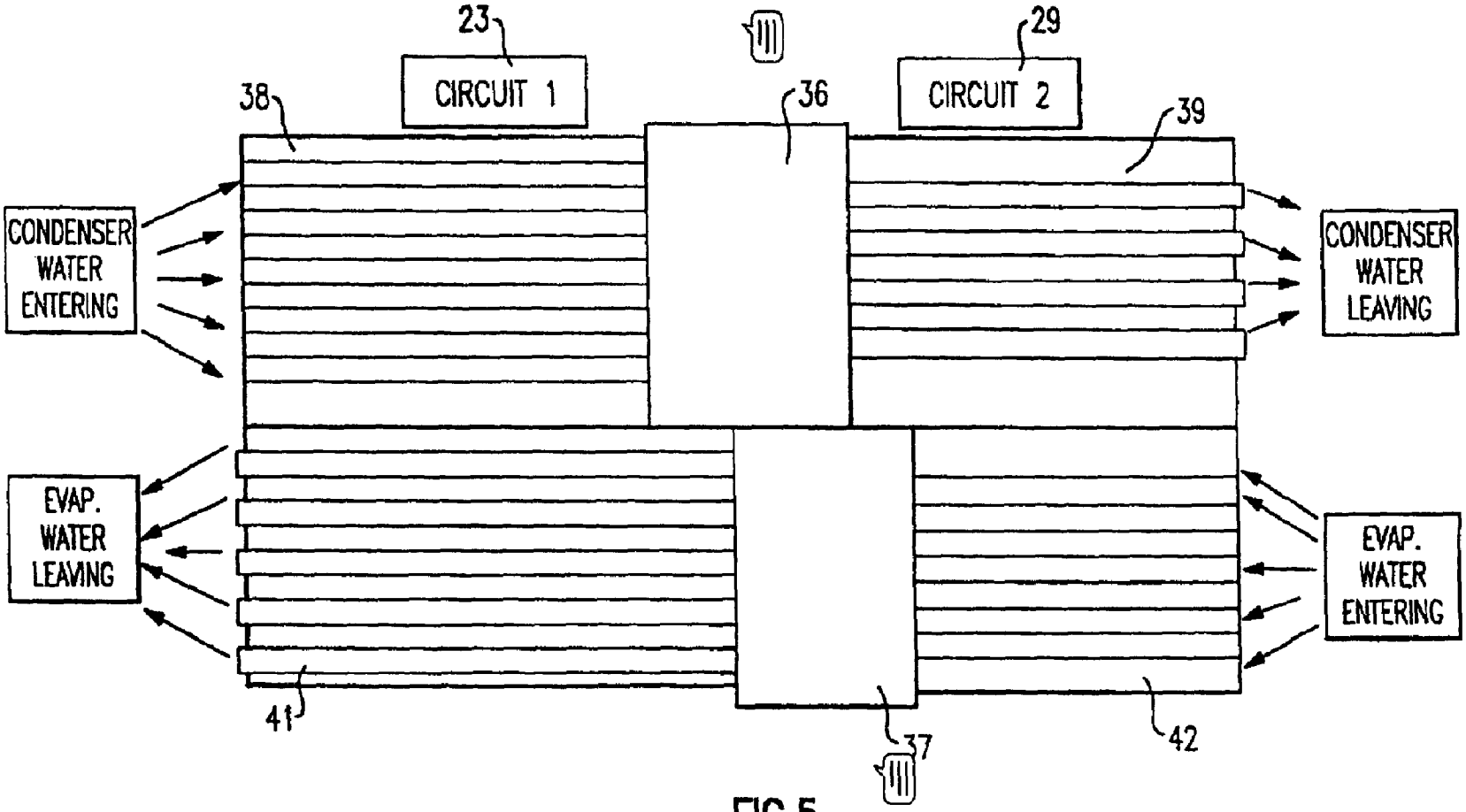
FIG. 5 is a schematic illustration of the condenser and evaporators in a dual-circuit system of one aspect of the present invention.

As shown in FIGS. 4 and 5, at an intermediate position between the two evaporators 27 and 33 is an evaporator waterbox 36, and at an intermediate position between the two condensers 24 and 31 is a condenser waterbox 37. Further, unlike the systems described hereinabove wherein the tubes are unitary tubes extending across both circuits, the condenser tubes 38 of circuit 1 are separate and independent from the condenser tubes 39 of circuit 2, and the evaporator tubes 41 in circuit 1 are separate and distinct from the evaporator tubes 42 of circuit 2. That is, the condenser tubes 38 are fluidly connected to one side of the waterbox 36 and the condenser tubes 39 are fluidly connected to the other side thereof. Similarly, the evaporator tubes 41 are fluidly connected to one side of the waterbox 37 and the evaporator tubes 42 are fluidly connected to the other side thereof. The waterboxes 36 and 37 therefore act as intermediate receptacles for the water as it passes between the first circuit 23 and second circuit 29.

The advantages of the above-described design are numerous. First of all, rather than having long unitary tubes, the tubes, and therefore the refrigeration circuits, are generally only about half as long and can be more easily handled and shipped to a site, with the tubes, and therefore the refrigeration circuits, being independent and separatable from the waterboxes. Second, since the tubes are independent, they can be configurable to optimize performance in each circuit. That is, in addition to the variation in length of the tubes in each circuit, the number of tubes within the second circuit can be different from those in the first circuit as shown in FIG. 5, and other variations can be made, such as different tube material, or different heat transfer enhancements. This allows the designer to optimize the desired capacity, efficiency, pressure drop, or cost for each circuit.

Figure 6:
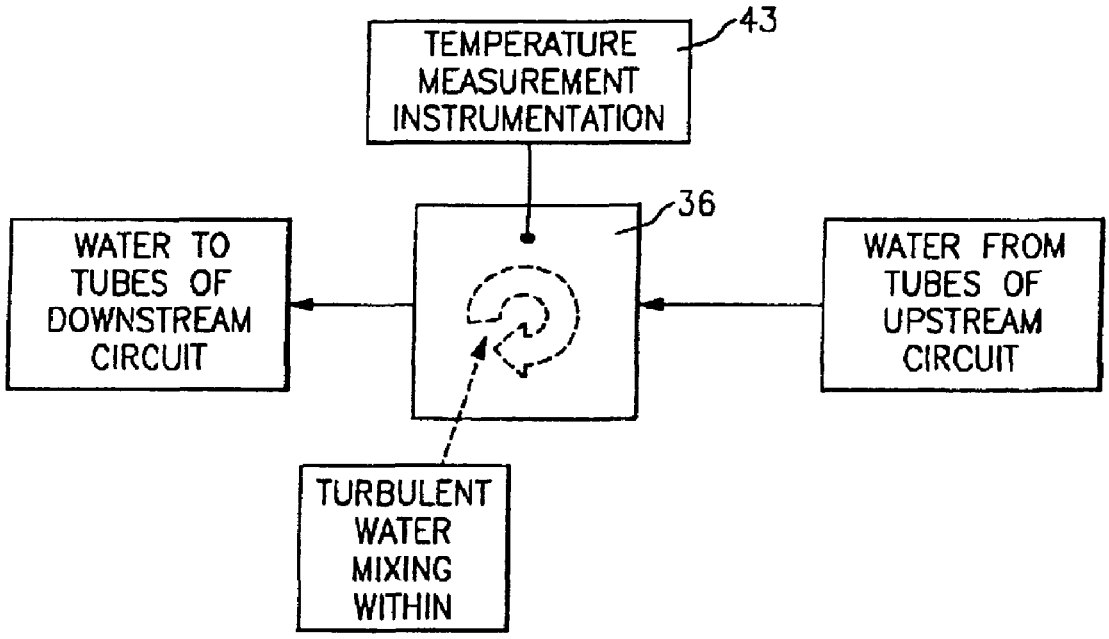
FIG. 6 is a schematic illustration of the waterbox portion of the dual-circuit system in accordance with one aspect of the present invention.

Other advantages of the present system can be seen by reference to FIG. 6. Because the water from the upstream tubes is discharged along one side of the waterbox 36 (or waterbox 37 in the case of the evaporator), it tends to cause a turbulence within the waterbox such that the individual flow streams are mixed so as to become a reservoir of water with a relative uniform temperature before it enters the tubes of the downstream circuit. This mixing is beneficial to the heat transfer effectiveness, thereby increasing COP of the total system.

By using the waterbox 36 as described, the intermediate waterbox 36 is now accessible from the outside and temperature measurement instrumentation 43 can easily be used to obtain the leaving temperature differential of the upstream heat exchangers, thus providing improved control of the system.

Another advantage of the use of waterboxes as described is that of facilitating service and repair. That is, since the waterbox is attached to the tube circuits in a manner that allows removal of the waterbox, as will be described hereinafter, the removal of the waterbox allows service of the tubes at each circuit's tubesheet, thereby substantially improving serviceability. Further, since a tube failure in either circuit does not create a refrigerant leak path to the adjacent circuit, the reliability of the system is substantially enhanced.

Figure 8:
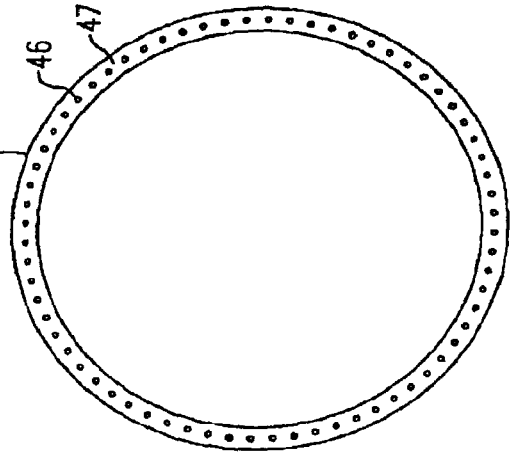
FIG. 8 is an end view of the waterbox portion of a dual-circuit system in accordance with one aspect of the present invention.
Figure 7:
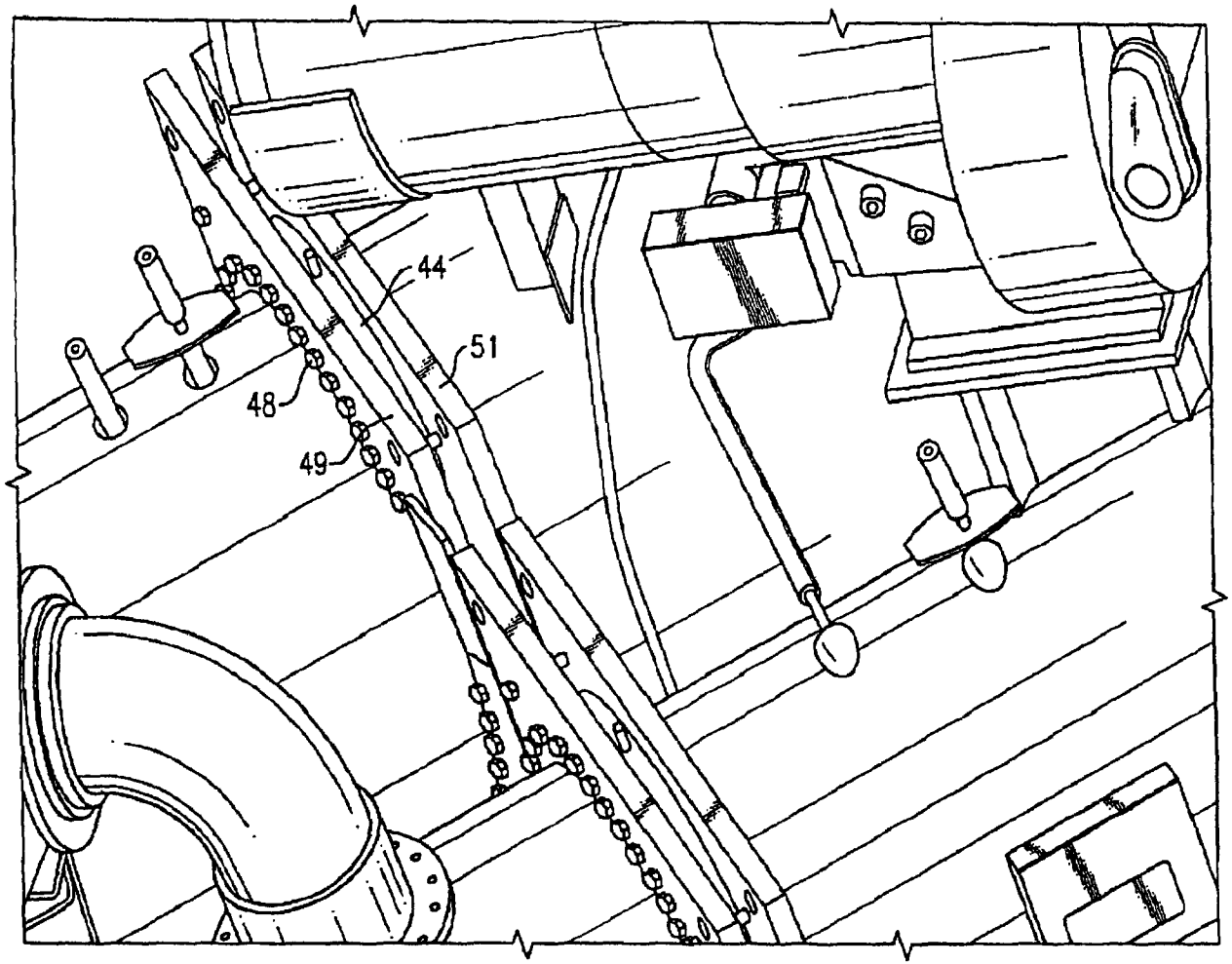
FIG. 7 is a perspective view of the waterbox portions of a dual-circuit system in accordance with one aspect of the present invention.

Referring now to FIGS. 7 and 8, the structural interface of the intermediate waterbox and the adjacent circuits are shown. As shown the intermediate waterbox 44 comprises a relatively short cylinder with a plurality of holes 46 formed longitudinally from one end 47 to the other, for receiving bolts 48 passing through the respective tubesheets 49 and 51. The waterbox, 44, is thus sandwiched between the tubesheets 49 and 51 of the respective circuits and can be easily disassembled by removing the bolts, 48, to get access to the tubes for repair purposes at the tubesheets between the circuits. It will therefore be recognized that each of the circuits is independent, and access can be gained to the intermediate tube to tubesheet joints without disrupting refrigerant boundary of either circuit.

Although the waterbox 44 is shown in FIGS. 7 and 8 as relatively short in length (i.e. about 4 inches), its configuration, size and shape can be substantially varied while remaining within the scope of the present invention. Further, although described in terms of use with a water cooled chiller, the present invention could also be applicable to an air cooled chiller wherein the evaporators of series connected circuits are interconnected by way of an intermediate waterbox structure.

Figure 9:
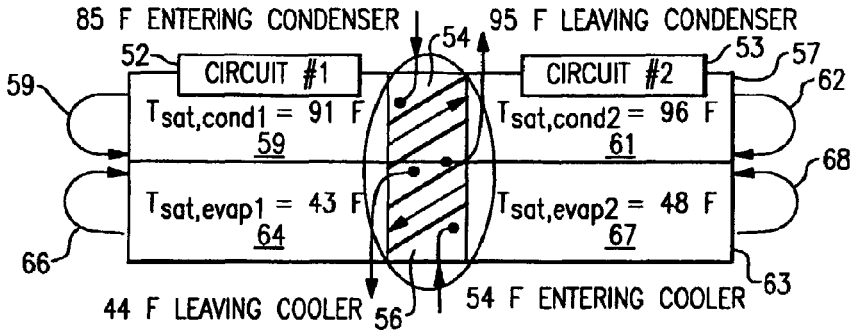
FIG. 9 is a schematic illustration of a waterbox arrangement in accordance with another aspect of the present invention.
Figure 10:
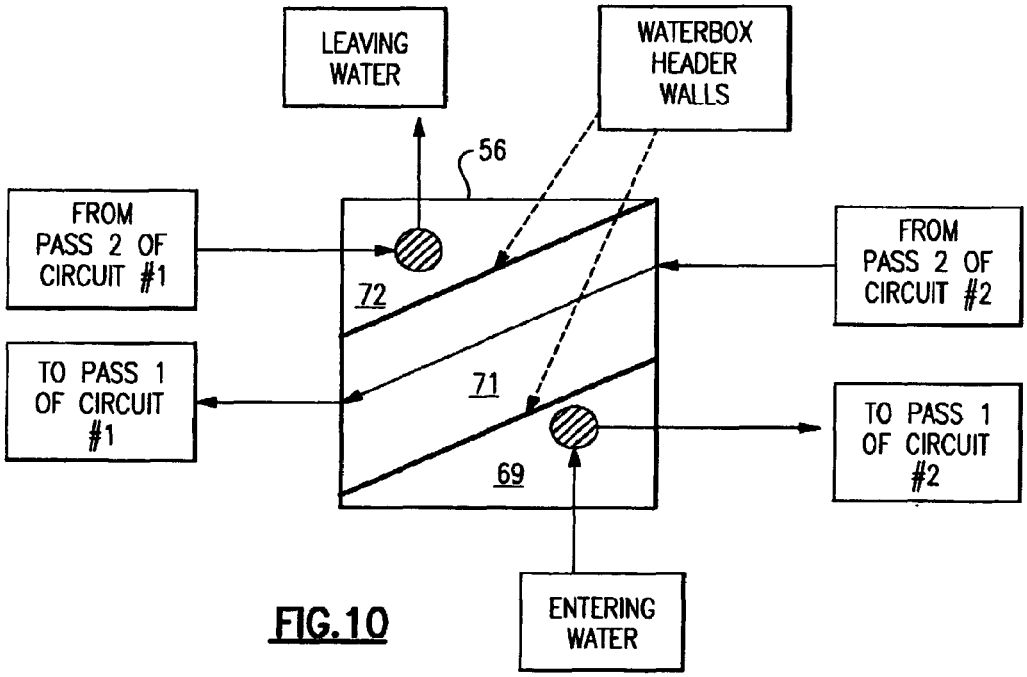
FIG. 10 is a further illustration thereof to show the flow directions and relationships thereof.

The embodiments of the invention as described hereinabove relate only to a single pass heat exchanger relationship. In order to obtain a two-pass arrangement, the intermediate waterboxes and the various leaving and entering connections must be significantly modified as are shown in FIGS. 9 and 10 and as will now be described.

Rather than having tubes that make a single pass through the heat exchangers, each of the circuits #1 and #2, 52 and 53, respectively, have their heat exchangers arranged such that the fluid makes two passes through each of the heat exchangers. That is, rather than the water entering at one end of the cooler and condenser as described hereinabove, the water enters and leaves the intermediate waterboxes 54 and 56, respectively, and then passes through each of the heat exchangers twice before leaving the respective waterboxes. In order for this to occur, each of the heat exchangers must have their tubes interconnected at their ends by way of return bends. Thus, within the condensers 57 of the circuits #1 and #2, the heat exchanger 58 has return bend 59, and the heat exchanger 61 has return bend 62. Similarly, in the cooler 63, heat exchanger 64 has return bend 66 and heat exchanger 67 has return bend 68.

The manner in which the water enters and leaves the circuits will now be described with reference to FIG. 10. The intermediate waterbox 56 for the cooler circuits 63 is divided into three passages 69, 71 and 72 as shown. The entering water flows into passage 69, then flows to the heat exchanger 67 where it passes first through pass 1, a return bend 68 and then pass 2 before it enters the passage 71 in the waterbox 56. It then passes into the heat exchanger 64, first through pass 1, then through the return bend 66 and then pass 2, before it enters the passage 72 of the waterbox 56 and then leaves the cooler.

In the condenser 57, the water flows into the intermediate waterbox 54 and then flows in the opposite direction from the water flowing from the waterbox 56 to the heat exchanger 67 (i.e. to the heat exchanger 58) where it passes first through a first pass, then through the return bend 59 and then back through the second pass, after which it passes into the middle passage of the waterbox 54. Note that the direction of flow is in the opposite direction from the flow in the middle passage 71 of the waterbox 56. It then passes into the heat exchanger 61, flowing first through a first pass, then through the return bend 62 and then through the second pass, prior to entering the waterbox 54 from which it then leaves.

It will thus be seen that, by the use of the intermediate waterboxes 54 and 56, and the selective direction of flow in each of the condensers 57 and the cooler 63, a two-pass, series counterflow arrangement is obtained. Further, the interconnections for the entering and leaving water in each of the intermediate waterboxes 54 and 56 are commonly located at the waterboxes themselves, thus facilitating easy access thereto.

We claim:

1. A chiller system of the type having first and second refrigeration circuits with each refrigeration circuit having a compressor, a condenser, an expansion device and an evaporator and with the respective evaporators in the first and second circuits having a plurality of tubes to conduct the flow of fluid to be cooled, and with the respective evaporators of the first and second circuits being interconnected in series relationship such that the fluid to be chilled passes serially through the respective evaporators of the first and second circuits, comprising:

an evaporator waterbox interconnected between the evaporators of the first and second circuits and having at least three passages therein with the first passage having a water inlet connection and a second passage having a water outlet connection;

each of the evaporators of the first and second circuits having first and second pass tubes interconnected at their ends by a return bend;

such that the water flows into said first passage and then into one of the evaporators of the first and second circuit, flowing serially through said first pass, said return bend and through said second pass, and then into a third passage of said evaporator waterbox prior to flowing through said other evaporator, flowing serially through said first pass, said return bend and through said second pass and then into said second passage and out the water outlet connection.

2. A chiller system as set forth in claim 1 wherein said respective condensers in the first and second circuits have a plurality of tubes to conduct the flow of fluid to be cooled, and with the respective condensers of the first and second circuits being interconnected in series relationship such that the fluid to chilled passes serially through the respective evaporators of the first and second circuits;

a condenser waterbox interconnected between the condensers of the first and second circuits and having at least three passages therein with the first passage having a water inlet connection and a second passage having a water outlet connection;

each of the condensers of the first and second circuits having first and second pass tubes interconnected at their ends by a return bend;

such that the water flows into said first passage and then into one of the condensers of the first or second circuit, flowing serially through said first pass, said return bend and through said second pass and then into a third passage of said condenser waterbox prior to flowing to said other condenser, flowing serially through said first pass, said return bend and through said second pass and then into said second passage of said condenser waterbox to said water outlet connection.

3. A chiller system as set forth in claim 2 wherein said condenser and evaporator waterboxes are so connected that the respective flows in the third passages of the respective condenser and evaporator are in opposite directions.

4. A chiller system as set forth in claim 2 wherein the direction of the water flowing from said evaporator waterbox to one of said evaporators is in an opposite direction from the flow of water flowing from said condenser waterbox to one of said condensers.

5. A dual-circuit chiller, comprising:

a first circuit having a compressor, a condenser, an expansion device and an evaporator, with the evaporator having at least one tube for conducting the flow of water to be cooled from an inlet end to a return bend and back to an outlet end of the tube;

a second circuit having a compressor, a condenser, an expansion device and an evaporator with the evaporator having at least one tube for conducting the flow of water to be cooled from an inlet end to a return bend and back to an outlet end of the tube; and an evaporator waterbox having inlet and outlet flow openings and being fluidly interconnected between said first circuit tube inlet and outlet ends and the second circuit tube inlet and outlet ends, such that water to be cooled flows into said evaporator waterbox, through said first circuit tube, back into said evaporator waterbox, through said second circuit tube, back into said evaporator waterbox and then out said outlet flow opening.

6. A dual-circuit chiller as set forth in claim 5 and including:

each of said first and second circuit condensers having at least one tube for conducting the flow of water to be cooled from an inlet to a return bend and back to an outlet end of the tube;

a condenser waterbox having inlet and outlet flow openings and being fluidly interconnected between said first tube inlet and outlet ends and the second circuit tube inlet and outlets ends, such that water be to cooled flows into said condenser waterbox, through said second circuit tube, back into said condenser waterbox, through said first circuit tube and back into said condenser waterbox, and then out said outlet flow opening.

7. A dual-circuit chiller as set forth in claim 6 wherein each of said evaporator and condenser waterboxes have three passages formed therein, with a first passage having the inlet flow opening a second passage having the outlet flow opening and a third passage for fluidly connecting the two evaporators/condenser.

8. A chiller system as set forth in claim 7 wherein said condenser and evaporator waterboxes are so connected that the respective flows in the third passages of the respective condenser and evaporator are in opposite directions.

9. A chiller system as set forth in claim 7 wherein direction of the water flowing from said evaporator waterbox to said first circuit tube is in an opposite direction from the flow of water flowing from said condenser waterbox to said second circuit tube.

* * * * *